United States Patent [19]

Baccile

[11] 4,060,330

[45] Nov. 29, 1977

[54] LOOSE LEAF BINDER LOCKING DEVICE

[75] Inventor: Anthony Baccile, Lansdowne, Pa.

[73] Assignee: Buchan Industries, Inc., Clifton Heights, Pa.

[21] Appl. No.: 713,380

[22] Filed: Aug. 11, 1976

[51] Int. Cl.[2] ..... B42F 5/02; B42F 13/30

[52] U.S. Cl. ..... 402/47; 402/48; 402/64

[58] Field of Search ..... 402/47, 48, 49, 54, 402/64, 50, 74, 46; 85/5 B; 24/244, 136 A, 45 L; 403/368

[56] References Cited

U.S. PATENT DOCUMENTS

| | | | |
|---|---|---|---|
| 917,610 | 4/1909 | Jones | 402/64 |
| 1,077,639 | 11/1913 | Pitt | 402/46 |
| 1,349,577 | 8/1920 | Nankervis | 402/64 |
| 1,393,265 | 10/1921 | Cooper | 24/264 |
| 1,911,801 | 5/1933 | Buchan | 402/64 |
| 1,972,417 | 9/1934 | Buchan | 402/50 |
| 2,167,685 | 8/1939 | Scherzinger | 402/50 |
| 2,553,886 | 5/1951 | Vevier | 402/74 |
| 2,836,182 | 5/1958 | Gramacy | 402/47 |

FOREIGN PATENT DOCUMENTS

| | | | |
|---|---|---|---|
| 18,315 of | 1906 | United Kingdom | 402/54 |

*Primary Examiner*—Jerome Schnall
*Attorney, Agent, or Firm*—Edelson and Udell

[57] ABSTRACT

A loose leaf binder having a pair of separable front and back cover members respectively hinged to relatively rigid interconnecting numbers of L-shaped cross-section adatped to be interfitted in overlapped relation to provide an expansible back for the binder. The L-shaped back-forming members are respectively provided with a lock post and a lock mechanism adapted to be interengaged by rectilinear insertion of the post into the lock mechanism, which latter is provided with a pair of coacting cylindrical rollers designed to frictionally engage and wedge therebetween opposite sides of the post inserted into the lock mechanism. One of said rollers is held rotatably captive in an axially fixed position while the other roller is movable into and out of wedging engagement with said lock post. The lock mechanism is provided with a swingable lever arm connected to a draw bar which acts to draw said movable roller out of its wedging engagement with the lock post, both the lever and the draw bar being normally biased by a single compression spring to hold said one roller in its wedged position against said post. The said roller is released from its wedging, i.e. post locking position, upon simple shifting of said lever in opposition to its biasing spring.

7 Claims, 8 Drawing Figures

FIG. 1
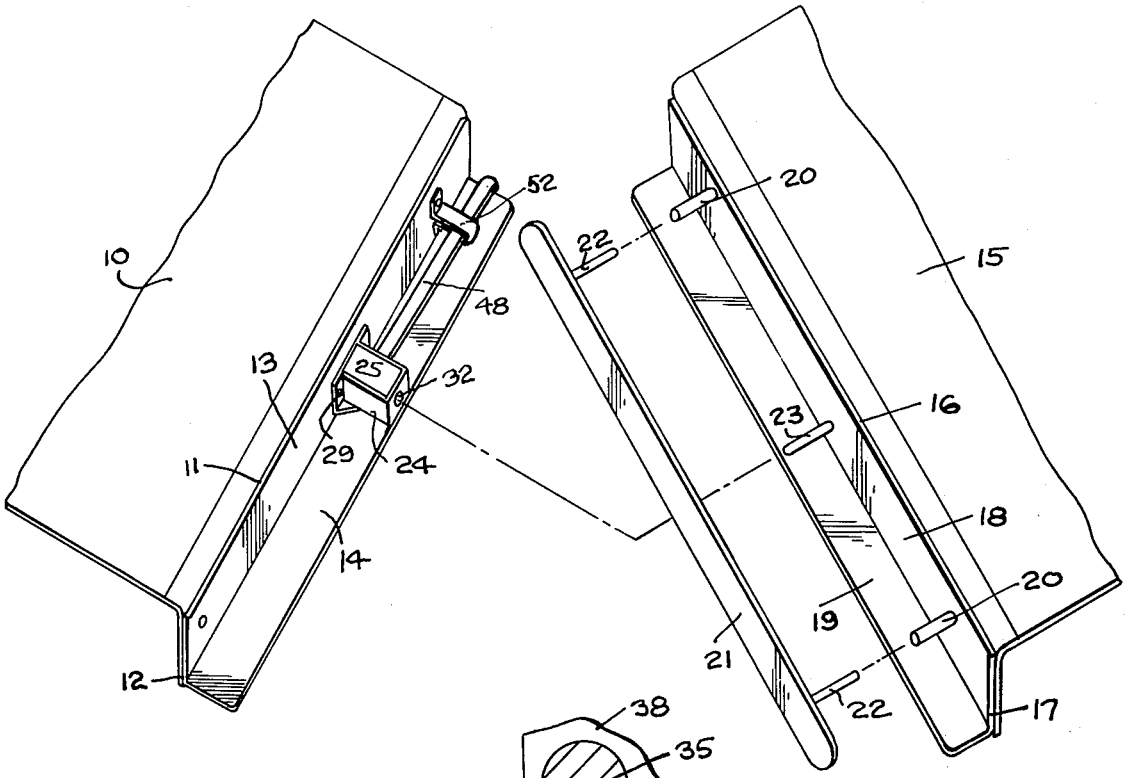
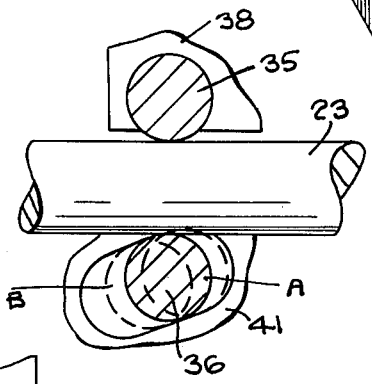
FIG. 8
FIG. 7
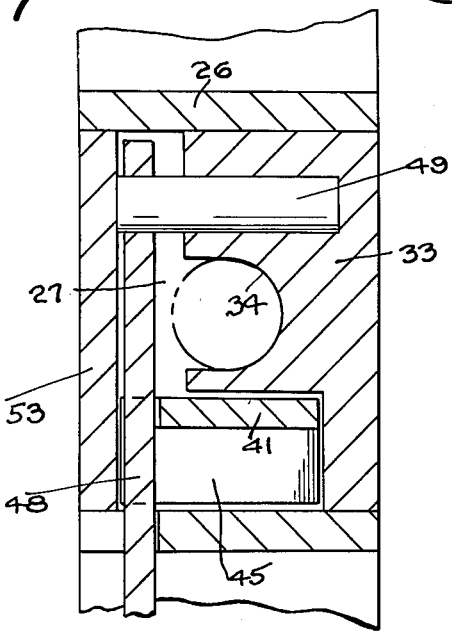
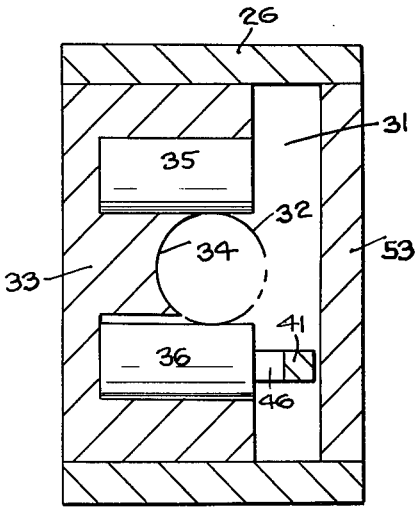
FIG. 6

FIG. 2
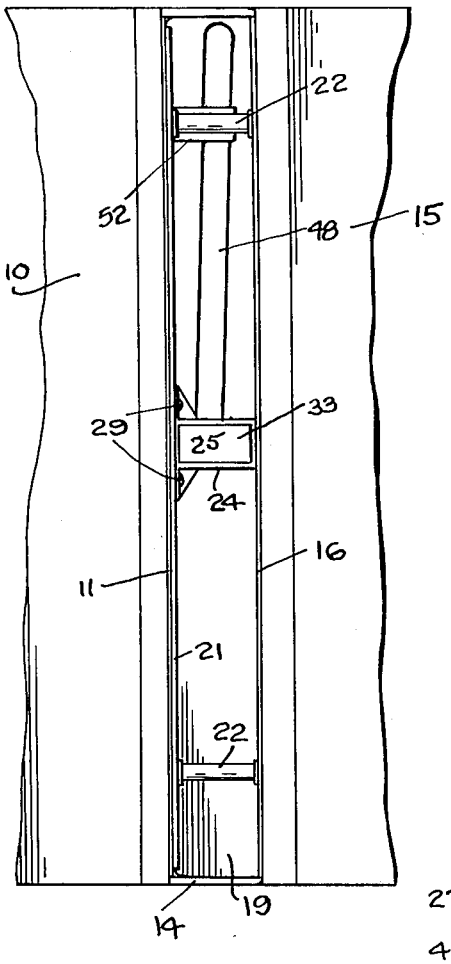
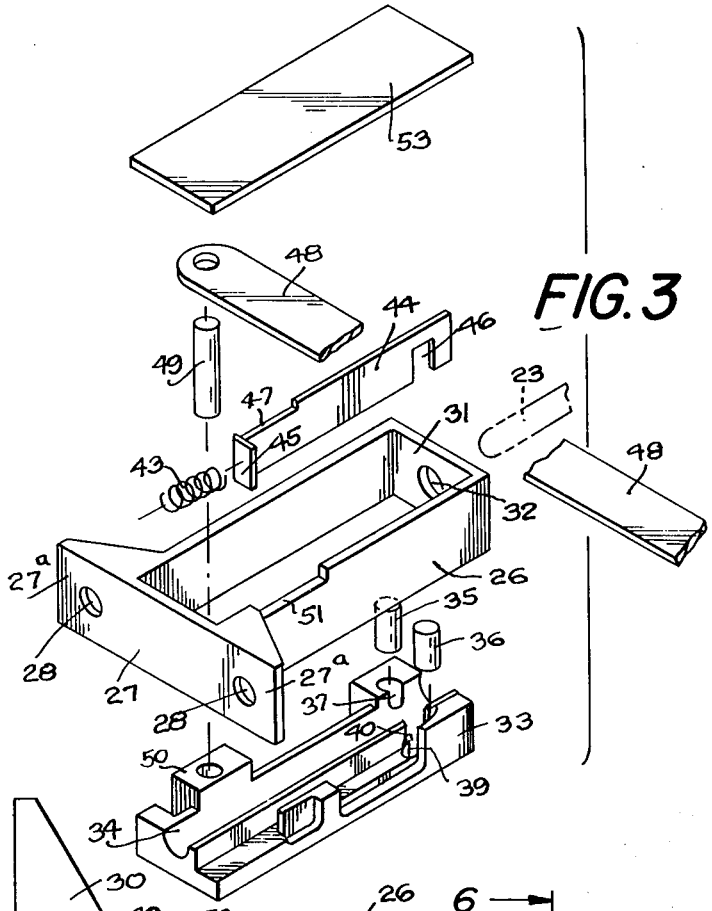
FIG. 3
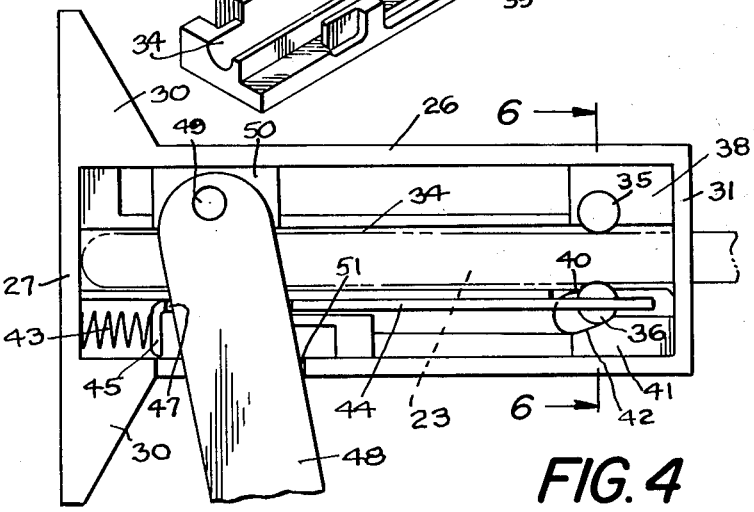
FIG. 4
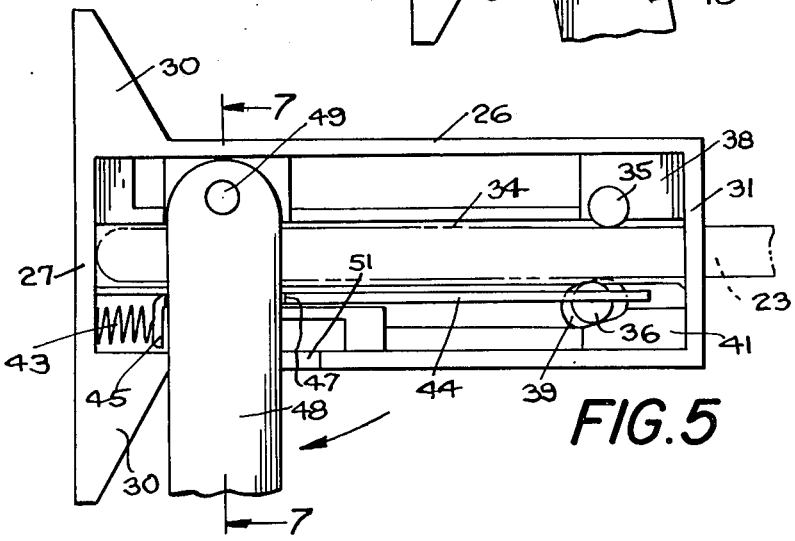
FIG. 5

LOOSE LEAF BINDER LOCKING DEVICE

This invention relates to loose leaf binders and more particularly to an improved lock mechanism for quick-releasably holding together the front and back cover members of a binder of the type in which said members are completely separable from one another for insertion and removal of loose leaf sheets therebetween.

Among the principal objects of the present invention is to provide a binder lock mechanism which is operative completely independently of the conventional binder posts which receive and hold the loose leaf sheets in the binder and which may be quickly and easily released to effect separation of the cover members for removal of loose leaf sheets from and replacement thereof in the binder as may be desired.

A further object of the invention to provide an improved construction or binder locking mechanism in which a pair of cylindrical roller elements are operative to engage diametrically opposite sides of a post which is axially freely insertable between said elements to the extent necessary to accommodate between the cover members a pack of sheets of a variable thickness, which roller elements are so disposed with their axes parallel relation to one another and normal to the axis of the post as to make straight line contact with the latter for automatic wedging engagement therewith to prevent unintended release of the post from the lock mechanism.

Still another object of the invention is to provide a lock mechanism of the character aforesaid wherein only one of said pair of rollers is normally spring-biased into clutching engagement with the binder lock post, which said one roller cooperates when in its biased clutching position with the other roller to frictionally engage the post between the two rollers at any point along the length of the portion thereof which is inserted into the lock mechanism to thereby hold the post secure against its withdrawal from the lock mechanism.

A still further object is to provide a conveniently operable lever arrangement which is manually operable to draw the spring-biased roller out of its clutched engagement with the lock post to thereby permit free and easy axial release of the lock post from the lock mechanism, which lever, under control of the same biasing spring that normally holds the spring-biased clutch roller in its post clutching position, is swingable with minimum effort against the bias of said spring to effectively declutch the post from the lock mechanism and so permit partial or complete separation of the binder covers.

Still another and important object of the present invention is to provide a lock mechanism which is of a generally flat and compact form adapted for disposition in the loose leaf binder in such manner that none of its parts interfere in any way with the folding of the binder front cover member into its normally flat folded condition in parallel relation to the back cover member and which includes as a part thereof the aforesaid operating lever having limiting swingable movement in a plane paralleling the back of the binder in underlying relation to the inner edges of the leaf material held in the binder. The lock mechanism itself into which the lock post of the binder is inserted also underlies the inner edges of the leaf sheets and so does not require the latter to be perforated except for the extensible binder posts on the back cover which initially receive the sheets prior to locked assembly of the front cover member on to the back cover member of the binder.

Other objects and advantages of the present invention will be apparent more fully hereinafter, it being understood that the invention consists in the combination, construction, location and relative arrangement of parts, all as described in detail in the following specification, as shown in the accompanying drawings and as finally pointed out in the appended claims. In the accompanying drawings:

FIG. 1 is an exploded view showing in perspective the several separated parts of the loose leaf binder in which is incorporated the improved locking means of the present invention;

FIG. 2 is an elevational view of the inside of the assembled binder as seen when the front and rear cover members thereof are oppositely swung into their opened positions;

FIG. 3 is an exploded view showing in perspective the several components of binder lock mechanism of the present invention;

FIG. 4 is a bottom plan view of the lock mechanism which is shown in FIG. 1 secured to the back of the binder front cover member, the lock operating lever being shown in its normal pin retaining position;

FIG. 5 is a plan view similar to FIG. 4 but showing the lock operating lever swung into position for release of the binder lock post from the lock mechanism;

FIG. 6 is an enlarged transverse cross-sectional view as taken along the line 6—6 of FIG. 4;

FIG. 7 is an enlarged transverse cross-sectional view as taken along the line 7—7 of FIG. 5; and FIG. 8 is an enlarged detail view showing the clutched engagement of the releasable post by the locking roller elements of lock mechanism.

Referring now to the drawings and more particularly to FIGS. 1 and 2, it will be observed that the locking mechanism of the present invention is shown incorporated in a loose-leaf binder of the type having separable front and rear cover members for accomodating therebetween a plurality of loose leaf sheets (not shown), the cover members being so interengaged as to permit them to be variably spaced apart to accomodate in the binder a correspondingly variable thickness of sheets. To this end, the front cover member 10 of the binder is hinged along its inner edge 11 to a relatively rigid L-shaped member 12 having a section 13 paralleling the plane of the loose leaf sheets and a section 14 extending normal to said plane, while the rear cover member 15 is similarly hinged along its inner edge 16 to a relatively rigid L-shaped member 17 having a section 18 paralleling the plane of the loose leaf sheets and a section 19 extending normal to said plane. When the two cover members 10 and 15 are interconnected by the means and in the manner hereinafter described, the sections 14 and 19 of the cover member overlap one another and form an expansible back for the binder, while at the same time the sections 13 and 18 are disposed in spaced parallel relation to overlie the top and bottom inner marginal surfaces of the pack of loose leaf sheets held in the binder.

The section 18 of the rear cover L-shaped member 17 is provided respectively adjacent its opposite ends with a pair of freely extending tubular binding posts 20—20 adapted to project through apertures suitably punched through the loose leaf sheets for which the binder is designed. A separate removable clamping bar 21 having binding posts 22—22 suitably secured thereto is provided for initially clamping the loose leaf sheets to the cover member 15, the posts 22—22 being spaced for telescopic engagement with the posts 20—20 so as to provide conjointly with the latter extensible posts for accomodating varying thicknesses of sheets held in the binder.

Also secured to the section 18 of the rear cover L-shaped member 17 is a third binding post 23, preferably of cylindrical solid form, which is centered between the binding posts 20—20 at a level substantially below the common plane of the posts 20—20 but above that of the binder back-forming section 19. This third binding post 23, which is preferably somewhat longer and of greater diameter than the posts 20—20, constitutes the retractable lock post for the binder locking mechanism designated generally by the reference numeral 24 in FIGS. 1 and 2.

As appears in said FIGS. 1 and 2, the locking mechanism 24 is fixedly secured to the section 13 of the front cover L-shaped member 12 centrally between the opposite ends thereof for axial alinement with the locking post 23 of the rear cover member 15. It should be noted that the lock mechanism 24 is of an overall depth such that when it is secured in position as shown in FIG. 1 and the front and rear cover numbers 10 and 15 are assembled with the clamping bar 21 telescoped onto the posts 20—20, the flat upper surface 25 of the lock mechanism, as viewed in FIGS. 1 and 2, lies in a plane which is spaced just below the bottom edge of the clamping bar 21 so that the latter is free to move inwardly across said top surface of the lock mechanism 24. Also, it will be apparent that the loose leaf sheets to be held in the binder will be so perforated for projection therethrough of the extensible posts 20–22 that upon insertion of said sheets in the binder the inner edges thereof will be more or less coplanar with the bottom edge of the clamping bar 21 and thus be held spaced above the top surface of the lock mechanism 24.

Referring now more specifically to FIGS. 3 to 8 which show the lock mechanism 24 of the present invention, it will be observed that this lock mechanism includes a open box-like casing 26 of generally rectangular form having an end wall 27 provided with oppositely projecting portions 27$^a$—27$^a$ which are apertured, as at 28—28, for the projection therethrough of mounting screws, rivets or bolts 29—29 (as see FIGS. 1 and 2). These mounting tabs 27$^a$—27$^a$ are preferably strengthened by integrally formed reinforcing gussets 30—30 located on the bottom side of the casing. The opposite outer end wall 31 of the casing 26 is apertured, as at 32, for projecting therethrough of the above mentioned locking post 23 which is secured to and forms a fixed part of the rear cover member 15 of the binder.

Suitably fitted and secured in the casing 26 is an internal body part 33 of the configuration best shown in FIG. 3. For ease of manufacture and for additional reasons hereinafter stated, this part 33 may be formed as a separate piece adapted to be fitted in the casing 26 as an insert which may be machined, cast or otherwise produced as an integral unit. However, if desired, this part 33 may be formed as an integral part of the casing 26. In either event, the part 33 includes a longitudinally extending groove 34 of arcuate cross-section disposed in coaxial alinement with the aperture 32 in the outer end wall of the casing. The groove 34 extending continuously between the opposite end walls of the casing 26 serves as a support and guide for the locking post 23 when the latter is inserted into the lock mechanism 24 through the casing aperture 32.

Fitted in the outer end of the internal body part 33 at opposite sides of the binding post guide groove 34 are a pair of cylindrical roller elements 35 and 36 adapted to engage therebetween opposite sides of the binding post 23 movable in said groove. The roller elements 35 and 36, acting as clutch elements, are disposed with their axes extending parallel to one another and perpendicular to the horizontal plane of the axis of the binding post 23. The cylindrical wall of the roller 35, which is held captive in a suitable cavity 37 provided therefor in a block 38 formed as a integral part of the insert 33, projects externally of its said cavity to an extent sufficient to freely engage one side of the post 23.

The second roller 36 is seated in an elongated recess 39 formed in the bottom of the insert 33 on the side of the post 23 opposite that engaged by the axially fixed roller 35, which recess 39 extends at an acute angle away from the post guide groove 34 and has its innermost end cut-away, as at 40, to provide a through-way for movement of said roller 36 into binding or clutching engagement with the locking post 23 when in its inserted position as shown in FIG. 4. The insert 33 is provided with a corner block 41 having a chamfered portion 42 in vertical extension of the outer wall of the recess 39, which chamfered portion provides a vertically extended surface for holding the roller 36 upright during its travel along the recess 39 into and out of its clutching position shown in FIG. 4.

The roller 36 is normally biased toward and into wedging engagement with one side of the locking post 23 at a point thereof which is so related to the point of engagement of the roller 35 with the opposite side of the post that the roller 35 and 36 conjointly act to frictionally grip the post 23 therebetween to thereby prevent outward withdrawal of the post from the locking mechanism 24. It will be noted that this gripping action occurs immediately as the roller 36 is cammed by the angled recess 39 into its dotted line position A shown in FIG. 8 and that this gripping action may take place at any point along the length the post 23, thereby providing locked engagement of the post by the rollers for any adjusted thickness of the pack or loose-leaf sheets held bound between the interconnected cover members of the binder.

Upon inward projection of the post 23 between the rollers 35 and 36, the roller 36 is free to move outwardly from its normally biased post engaging position A toward its dotted line position B shown in FIG. 8, thereby permitting the post 23 to be freely shifted inwardly between the rollers to any desired adjusted position up to the limit of its permissible travel, which limit is reached upon engagement of the free end of the post 23 with the end wall 27 of the lock mechanism 24 (as see FIGS. 4 and 5).

The movable roller 36 is spring biased into wedging engagement with the locking post 23 by means of a coiled compression spring 43 acting through the intervention of a shiftable draw bar 44 suitably guided for movement in the insert member 33. This draw bar 44 is in the form of a flat stamping having its inner end bent, as at 45, to provide a flat abutment for the spring 43 and its opposite end portion notched along its bottom edge, as at 46, to embrace the top portion of the movable roller 36. The draw bar 44 is disposed in a vertical plane substantially coincident with the vertical axis of the roller 36 whereby as said draw bar 44 is shifted in its plane of movement in opposite directions the roller 36 is constrained to move therewith into and out of its dotted line positions A and B shown in FIGS. 8. The upper edge portion of the draw bar 44 immediately adjacent the end abutment 45 thereof is notched, as at 47 to provide a recess for accomodating an elongated operating lever 48 which extends laterally of the lock mechanism 24 as is best shown in FIGS. 1 and 2.

This operating lever 48 , which is in the form of a horizontally disposed flat stamping of a thickness slightly less than the depth of the notch 47 in the draw bar is pivoted at its inner end about a pivot pin 49 suitably fitted in a boss 50 integrally formed in the internal body portion of the lock mechanism. The top surfaces of the operating lever 48, the draw bar 44 and the pivot pin 49 are all preferably disposed in a common plane and to this end the side wall of the lock mechanism casing 26 through which the operating lever projects is notched or recessed as at 51 for flatwise accomodation therein of the operating lever 48. It will be noted that the recess 51 of a length sufficiently greater than the width of the lever as to permit limited swinging movement of the lever in the plane thereof and about its pivot as the coil spring 43 is alternately compressed and expanded. The free end portion of the operating lever 48 is preferably held against undesired vertical deflection out of its horizontal plane of movement by a bracket 52 suitably secured to the section 13 of the binder front cover member 10, this section 13 being that to which the lock mechanism 24 is also secured, as see FIGS. 1 and 2.

Although the exposed bottom side of the lock mechanism may be covered by the section 14 of the cover member 10 when the mechanism is mounted flat against said section, it is preferable to protectively enclose the bottom of said mechanism by a cover plate 53 which is set into the casing 26 with its upper surface flush with the top edges of the casing as shown in FIGS. 6 and 7. This cover plate may be detachably or permanently secured in position by any suitable means.

In use of the binder of the present invention, the loose leaf sheets (not shown) which are suitably perforated for disposition upon the extensible binding posts of the rear cover member are initially clamped between the section 18 of said cover member and the clamping bar 21 with the posts 22—22 of the latter respectively in telescopic engagement with the tubular binding posts 20—20.

The rear cover member with its clamped assembly of the loose leaf sheets is then interconnected with the front cover member by projection of the locking post 23 of said rear cover member into and through the aperture 32 in the end wall 31 of the lock mechanism 24 of the front cover member. In this operation of interconnecting the front and rear cover members, the section 19 of the rear cover member will be disposed in underlying relation to the section 14 of the front cover member and thus effectively provide an expansible spline or back for the binder which operates conjointly with the extensible binding posts 20–22 to adjust the spacing of the binder cover to the thickness of the pack of sheets held bound in the binder.

Operation of the locking mechanism is as follows: As the post 23 is inserted into the lock mechanism through the aperture 32 thereof, it moves between the rollers 35 and 36 and in so doing causes the roller 36 to move angularly away from the path of travel of said post along the guide groove 34 to an extent sufficient to release said roller 36 from frictional binding engagement with the post 23. It will be apparent that upon projection of the post 23 through the gap provided between the rollers 35 and 36, it will automatically effect this angular movement of the roller away from the path of travel of the locking post against the biasing force of the coil spring 43 acting upon the draw bar 44 which engages the shiftable roller 36. Should it be desired to manually shift the movable roller 36 out of its normal post-locking position shown in FIG. 4 to facilitate initial projection of the post 23 through the gap provided between the rollers 35 and 36, the operating lever 48 may be swung from its position shown in FIG. 4 into its position shown in FIG. 5 to thereby draw the roller 36 against the bias of the spring 43 by the draw bar 44 with which the operating lever is engaged. FIG. 5 shows the roller 36 in its de-clutched position relatively to the locking post 23.

The lock post 23 is locked against outward withdrawal from between the rollers 35 and 36 automatically as the operating lever 48 swings into its position shown in FIG. 4 under the biasing force of the coil spring 43 acting upon the draw bar 44 with which the operating lever is engaged and in which position of the operating lever the roller 36 is shifted into binding engagement with the post 23. It will be apparent that any force applied to the post for withdrawal thereof from between the rollers 25 and 36 will only cause the roller 36 to be drawn more tightly against the post.

To release the post 23 for partial or complete withdrawal thereof from between the rollers 35 and 36 clutched to the post as shown in FIG. 4, it is only necessary to swing the lever 48 out of its normal spring-pressed position shown into its position shown in FIG. 5, whereby to withdraw the roller 36 from its clutching engagement with the post 23 through the intervention of the shiftable draw bar 44.

An important advantage of the lock mechanism of the present invention resides in the fact that the cylindrical rollers respectively provide for straight line tangential contact with diametrically opposite sides of the lock post 23 of the binder and thus assure secure gripping engagement with the post inserted therebetween despite any possible play of the post in the vertical plane of its path of travel into the lock mechanism. Also, the use of cylindrical clutching rollers as hereinabove described obviates the possibility of jamming of the clutch elements on the post as may occur in the case of ball-shaped clutch elements which form indentations in the post when the balls are forced too tightly into engagement with the locking post.

As has been previously indicated, the insert 33 may be formed either as an integral part of the casing member 26 as a separately formed part adapted to be fixedly secured in a casing such as the casing member 26 and the lock mechanism as a whole and all essential parts thereof may be cast, machined or otherwise formed of any suitable material.

An important and desirable advantage of making the insert 33 as a part separate from the casing member 26 is that by producing it of a standard overall length it may be fitted in casings such as the casing member 26 which are of different overall lengths as may be required for use in binders of various capacities. Thus, for use of the locking mechanism of the present invention in a binder of a capacity greater than that which may be afforded by the structure as shown in FIG. 4 wherein the insert 33 occupies the full length of the internal recess of the casing member 26, it is only necessary to increase the length of the casing member 26 to the extent required for the desired increased capacity of the binder. This of course would leave a free space between the corresponding inner or rear ends of the insert 33 and its casing 26, but since the cylindrical clutch members 35 and 36 are disposed at the outer or front end of the insert 33 which remain in abutting position against the corresponding front wall 31 of the casing, they would still be effectively operable upon the lock post 23 of the binder to hold said post in its adjustably locked position. The only requirement for use of such a standardized length of insert 33 in a casing member 26 of a desired increased length would be to increase either the effective length of the coil spring 43 or of the draw bar 44 to compensate for the increased length of space between the end 45 of the draw bar 44 and the internal face of the end wall 27 of the casing member 26.

It will be understood that the present invention is susceptible of various changes and modifications which may be made from time to time without departing from the real spirit or principles of the invention and it is accordingly intended to claim the same broadly as well as specifically as indicated by the appended claims.

What is claimed as new and useful is:

1. In a loose leaf binder of the type having separable front and back cover members having coacting telescopically extensible posts which project through perforations in the loose leaf sheets for holding the same positioned between said cover members, a locking mechanism for releasably securing said cover members together comprising in combination a locking post on a first one of said cover members and a lock device on the other one of said cover members adapted to telescopically receive said locking post, said lock device including an elongated main body part having an elongated guide channel conforming to the shape of said locking post and extending substantially the entire length of said main body part into which said locking post is rectilinearly insertable, a pair of post-clutching roller elements respectively disposed at opposte sides of said channel adjacent the entrance thereto and adapted to frictionally engage diametrically opposite sides of said locking post at any point along the length of the portion of the post which is received in said channel, one of said elements being held in a fixed position for constant frictional engagement with one side of said post and the other of said elements being shiftable relatively to said channel for movement thereof into and out of locking engagement with the opposite side of said locking post, said shiftable element being normally biased into a position wherein it coacts with said axially fixed element to automatically clutch said locking post against withdrawal from said channel, means operative to positively draw said shiftable element out of clutching engagement with said locking post whereby to release the same for its partial or complete withdrawal from said lock device, said means including a rectilinearly shiftable elongated draw bar which is disposed in closely spaced parallel relation to only one side of said locking post guide channel and is operatively connected at its outer end to said shiftable roller element for moving the latter into and out of said locking engagement with said locking post, spring means acting on the inner end of said bar to normally bias the same outwardly whereby the automatically effect clutching engagement of said shiftable roller element with said locking post, and an operating lever wholly confined between the covers of said binder, said lever being pivoted within said locking device and connected to said bar cross-wise thereof for limited swinging movement through an arc of very small degree in a plane extending parallel to the path of movement of said bar and the expansible back of the binder, said operating lever being manually actuatable against the bias of said spring means to draw said bar into its post unlocking position and automatically shiftable into inactive position solely under the biasing effort of said spring means.

2. In a loose leaf binder as defined in claim 1 wherein said rectilinearly shiftable draw bar consists of a substantially flat member which stands on its longitudinally extending bottom edge in a vertical plane intersecting said shiftable roller element and engages the latter to positively move the same into and out of locking engagement with said locking post.

3. In a loose leaf binder as defined in claim 2 wherein said draw bar is provided adjacent its outer end with a downwardly presenting notch in which is nested said shiftable roller element.

4. A lock mechanism as defined in claim 1 wherein said operating lever is in the form of a flat member and the inner end portion of said draw bar is provided in its top edge with a notch in which said operating lever is flat-wise disposed with its upper surface substantially flush with said edge of said draw bar.

5. In a loose leaf binder as defined in claim 1 wherein said other one of said cover members is provided with a removable clamp bar overlying the loose leaf sheets held in the binder and wherein said coacting telescopically extending posts are respectively carried by said clamp bar and said first one of said cover member.

6. A lock mechanism for a loose leaf binder having a pair of separable cover members respectively provided with overlapping expansible back-forming sections, in combination, a cylindrical locking post on one of said covers extending freely therefrom in spaced parallel relation to the back-forming section of said one cover member, and a coacting locking device secured to the other of said cover members for telescopically receiving said locking post for releasably securing said cover members together, said locking device including an elongated box-like structure having a pair of longitudinally spaced end walls, a pair of longitudinally extending sidewalls and top and bottom closure walls, said structure being internally provided with a body part having an elongated groove of arcuate cross-section conforming to the shape of said locking post and extending substantially the entire length of the structure disposed in axial alinement with said locking post, the free outer end of said groove being in registry with an entrance opening provided in the outer one of said end walls for holding said locking post seated in said groove in coaxial registry therewith upon insertion therein of said post, a pair of cylindrical elements respectively socketed within said structure upon opposite sides of said groove adjacent its entrance opening, said elements having wall portions thereof adapted to engage diametrically opposite sides of the locking post along vertically extending parallel lines respectively extending tangent to the circumference of said locking post, one of said elements being socketed in an elongated recess extending at an angle with respect to the longitudinal axis of said groove whereby to permit movement of said one element into and out of wedging engagement with said locking post, the outer wall of said recess serving as a surface for camming the element socketed therein into wedging engagement with the locking post, means engagable with said movable element for positively drawing the latter out of its wedging engagement with said locking post, said means including an elongated substantially flat draw bar rectilinearly shiftable in the plane thereof along a line closely adjacent to and paralleling said groove, the outer end portion of said draw bar having its bottom edge notched to captively engage said movable element, spring means acting on the inner end of said draw bar for normally biasing said movable element held captive by said draw bar along said cam surface into wedging position against the locking post, and an operating lever internally pivoted within and extending externally of said structure and swingable in a plane parallel to the back-forming sections of the binder for manually retracting said draw bar against the biasing effort of said spring means to release the movable element from its wedging position and so permit complete or partial withdrawal of said locking post from said locking device, said operating lever being automatically shiftable into inactive position under the sole influence of said spring means.

7. A lock mechanism as defined in claim 6 wherein said internal body part member is formed as a separate insert member adapted to be fixedly positioned between said spaced end walls of said support structure with the front end thereof in closely abutting relation to said outer one of said end walls, and wherein the longitudinal spacing between said end walls determines the capacity of the loose leaf binder in which said locking mechanism is incorporated.

* * * * *